US008192228B2

(12) United States Patent
Taylor

(10) Patent No.: US 8,192,228 B2
(45) Date of Patent: Jun. 5, 2012

(54) ELECTRONIC ASSEMBLY INCLUDING RF FEEDTHROUGH CONNECTOR AND RELATED METHODS

(75) Inventor: Edward Allen Taylor, West Melbourne, FL (US)

(73) Assignees: SRI Hermatics Inc., West Melbourne, FL (US); H-Tech, LLC, Melbourne, FL (US)

( * ) Notice: Subject to any disclaimer, the term of this patent is extended or adjusted under 35 U.S.C. 154(b) by 510 days.

(21) Appl. No.: 12/391,847

(22) Filed: Feb. 24, 2009

(65) Prior Publication Data

US 2009/0211806 A1 Aug. 27, 2009

Related U.S. Application Data

(60) Provisional application No. 61/031,455, filed on Feb. 26, 2008.

(51) Int. Cl.
*H01R 13/40* (2006.01)

(52) U.S. Cl. ..... 439/586; 174/520; 174/564

(58) Field of Classification Search ..... 174/650, 174/658; 439/382–385, 95, 586
See application file for complete search history.

(56) References Cited

U.S. PATENT DOCUMENTS 4,037,902 A * 7/1977 Miller ..... 439/294
4,490,576 A * 12/1984 Bolante et al. ..... 174/655
5,687,453 A * 11/1997 Megregian et al. ..... 16/221
5,702,076 A * 12/1997 Humber ..... 248/57
5,986,208 A 11/1999 Taylor et al. ..... 174/50.58
6,194,659 B1 * 2/2001 Cornu ..... 174/659
6,278,061 B1 * 8/2001 Daoud ..... 174/659
7,131,867 B1 11/2006 Foster et al. ..... 439/578
7,144,274 B2 12/2006 Taylor ..... 439/586
7,300,310 B2 * 11/2007 Taylor ..... 439/586
7,365,620 B2 * 4/2008 Taylor ..... 333/252
7,517,258 B1 * 4/2009 Taylor ..... 439/736
7,579,557 B2 * 8/2009 Tapper ..... 174/650

OTHER PUBLICATIONS

Definition of term "displaceable", Oxford English Dictionary, printed Dec. 15, 2011, http://www.oed.com/.*

* cited by examiner

*Primary Examiner* — Quyen Leung
*Assistant Examiner* — Thomas Truong
(74) *Attorney, Agent, or Firm* — Allen, Dyer, Doppelt, Milbrath & Gilchrist, P.A.

(57) ABSTRACT

An electronic assembly may include a housing having an opening therein and an RF feedthrough connector in the opening of the housing. The RF feedthrough connector may include a tubular body, and a plurality of displaceable protrusions carried by an upper outer surface portion of the tubular body. The plurality of displaceable protrusions may define an enlarged upper portion thereof engaging adjacent upper portions of the housing. The RF feedthrough connector may also include a sealed joint between the housing and the RF feedthrough connector.

25 Claims, 5 Drawing Sheets

ELECTRONIC ASSEMBLY INCLUDING RF FEEDTHROUGH CONNECTOR AND RELATED METHODS

RELATED APPLICATION

The present invention claims priority from U.S. Provisional Application No. 61/031,455 filed Feb. 26, 2008, entitled "Techniques For Manufacturing And Installing Improved Weldable Coaxial RF Connectors", which is incorporated herein by reference.

FIELD OF THE INVENTION

The present invention relates to the field of electronic assemblies, and, more particularly, to RF feedthrough connector assemblies, and associated methods for making the RF feedthrough connector assemblies.

BACKGROUND OF THE INVENTION

In approximately 1992, weldable RF connectors were introduced to the hermetic packaging industry as a substitute for solder-in feedthroughs that were being installed into aluminum microwave electronic packaging. The solder feedthrough system includes a low thermal expansion glass-to-metal-seal with an electroplated metal ferrule that is fixed within an electroplated receiving hole in the side wall of an aluminum electronic housing via a wetted solder joint. Due to the difference in coefficients of thermal expansion between the glass-to-metal-seal and the aluminum housing, these solder joints are inherently unreliable when subjected to multiple thermal cycles.

Over the last fifteen-years there have been many different types of weldable feedthroughs/connectors produced and although they increase the hermetic reliability of an aluminum package, which was the primary design goal of this product, the weldable feedthroughs and connectors are not without flaws.

When an RF coaxial feedthrough or connector is installed in an electronic package it may be desirable to mount it in a way that produces a short continuous path for the ground signal. The primary signal runs down the center wire in a coaxial cable and the ground signal runs down the shielded jacket outside the dielectric. For high frequency applications, microwave and higher, it may be important that these two signals run at the same pace as each other to keep the signal in-phase. If the primary signal runs ahead of the ground signal, the combined signal will become out-of-phase. An out-of-phase signal may exhibit noise and static and generally be of poor quality.

Any time there is a physical change in the signal paths of the coaxial cable there is a challenge to keep the signal "clean" and in-phase. For example, when a cable is attached to a connector and the connector is mounted on or within a sidewall of an electronic housing, physical change may occur that can disrupt the RF signal if not designed properly. The primary signal path is typically always carried on the center conductor of the cable and has a straight path through the connector/feedthrough into a circuit board, for example. The design challenge comes from trying to make the ground signal travel the same distance as the primary signal when it is running through the connector and into the electronic package. Any disruption or increase in ground path distance relative to the primary signal path distance may cause unwanted noise in the transition from the cable to the circuit board.

FIG. 1 illustrates a prior art coaxial connector 100 in perspective view and in an exploded relationship with a mounting hole (hole detail) 120. The coaxial connector 100 has a dielectric body 110 surrounding the center conductor 115, which isolates it from the metallic components of the coaxial connector 100. In the prior art, to ensure a good connection between the ground signal, which travels near the surface of the dielectric and the metallic substrate to which the coaxial connector 100 is mounted, four spring clips 105 are positioned to facilitate the transfer of the ground signal to the metallic substrate 150 in which the hole detail is provided. In the prior art, the hole detail is sized to provide a slip fit for the coaxial connector 100 so that it may easily fit into the hole detail.

During installation, the coaxial connector 100 is placed into the hole detail and held in place, for example with tweezers, during a welding process, using, for example, a laser welder, in which the welding beam progresses circularly around the circumference of the boundary between the hole detail and the substrate, forming welds 130 which form a hermetic seal between the coaxial connector 100 and the substrate 150.

The solder-in feedthroughs described above, were particularly unsuitable for providing hermetic seals because of the solder fatigue, which results from thermal recycling. When used in avionics, for example, the solder joint might range in temperature from 80° C., when an aircraft was located on a landing strip in the middle of a desert, to 65° C. when the same aircraft was located at an altitude of 70,000 feet. After a certain number of thermal cycles, the solder-in feedthroughs may fail and the hermetic seal may be lost.

The weldable connectors improved the thermal recycling properties and substantially addressed the problems of thermal recycling. However, the weldable connectors produced other problems. When using connectors at high frequencies, for example, between 2 Ghz and 100 Ghz, it may be important that the ground signal path be the same length as the path through the center conductor of a coaxial transmission line. At these high frequencies, even a slight variation in path length may result in substantial interference.

Further, the installation process for the weldable connectors for use at high frequencies is very sensitive. There is for example the need to keep the connectors centered within the hole detail of the housing to have a reproducible impedance. Further, the technique of holding the connector in place with tweezers still permits wiggle room between the connector and the slip fit sized hole detail.

When performing a laser weld operation, the laser beam weld results in displacement of metal on the hot side of the connector while the opposite side of the connector remains cool. This can cause the axis of symmetry through the connector to become off normal or tilted with respect to the substrate, which can disturb and create gaps in the RF ground plane. Specifically, any tilt in the coaxial connector 100 shown in FIG. 1, may result in one of the ground signal pins 105 lifting away from the substrate and thus provide a less than adequate connection. This could disturb and create gaps in the RF ground plane. It may be desirable that the coaxial connector 100 remain concentric within the hole detail of the housing after welding to function properly and maintain a matched impedance. The ground signal may desirably stay close to the dielectric to maintain a (typically) 50 ohm impedance. Particularly with short coaxial connectors 100, the welding process may result in sufficient tilt so that there is, instead of 360 degrees of contact between the coaxial connector 100 and the contact for the ground springs 105, there may be as little as 180 degrees of contact and very poor concentricity.

Still further, removal or replacement of the coaxial connector 100 from the hole detail 120 typically involves removing the welds 130. Removal of the welds may damage both the hole detail 120 and the coaxial connector 100. Thus, there is an increased cost with removal or replacement of the coaxial cable 100 as the hole detail may have to be replaced, or have remaining burrs removed.

SUMMARY OF THE INVENTION

In view of the foregoing background, it is therefore an object of the present invention to provide an electronic assembly including an RF feedthrough connector having increased stability and reduced noise production.

This and other objects, features, and advantages in accordance with the present invention are provided by an electronic assembly that may include a housing having an opening therein, and an RF feedthrough connector in the opening of the housing. The RF feedthrough connector may include a tubular body, and a plurality of displaceable protrusions carried by an upper outer surface portion of the tubular body. The plurality of displaceable protrusions may define an enlarged upper portion thereof engaging adjacent upper portions of the housing. The RF feedthrough connector may also include a sealed joint between the housing and the RF feedthrough connector. Accordingly, the electronic assembly includes an RF feedthrough connector that provides increased stability and reduced noise.

The tubular body may define a longitudinal axis, and the plurality of displaceable protrusions may include a plurality of spaced ridges extending parallel with the longitudinal axis, for example. The sealed joint may include a welded joint.

The opening may include a cylindrical opening having a flat bottom. In addition, the electronic assembly may further include a flat spring between the tubular body and the housing at the flat bottom of the cylindrical opening. The flat spring may include an annular flat portion and a plurality of spring petals carried within an interior thereof. The plurality of spring petals may define a pin receiving passageway therein.

The RF feedthrough connector further may also include a dielectric material within the tubular body and at least one pin extending through the dielectric material. The tubular body may be explosion welded metal in some embodiments.

Another aspect is directed to a method of making an electronic assembly. The method may include positioning an RF feedthrough connector in an opening of a housing. The RF feedthrough connector may include a tubular body having a plurality of displaceable protrusions carried by an upper outer surface portion thereof to define an enlarged upper portion thereof to engage adjacent upper portions of the housing. The plurality of displaceable protrusions may be displaced when engaged with the adjacent upper portions of the housing. The method may also include forming a sealed joint between the housing and the RF feedthrough connector.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
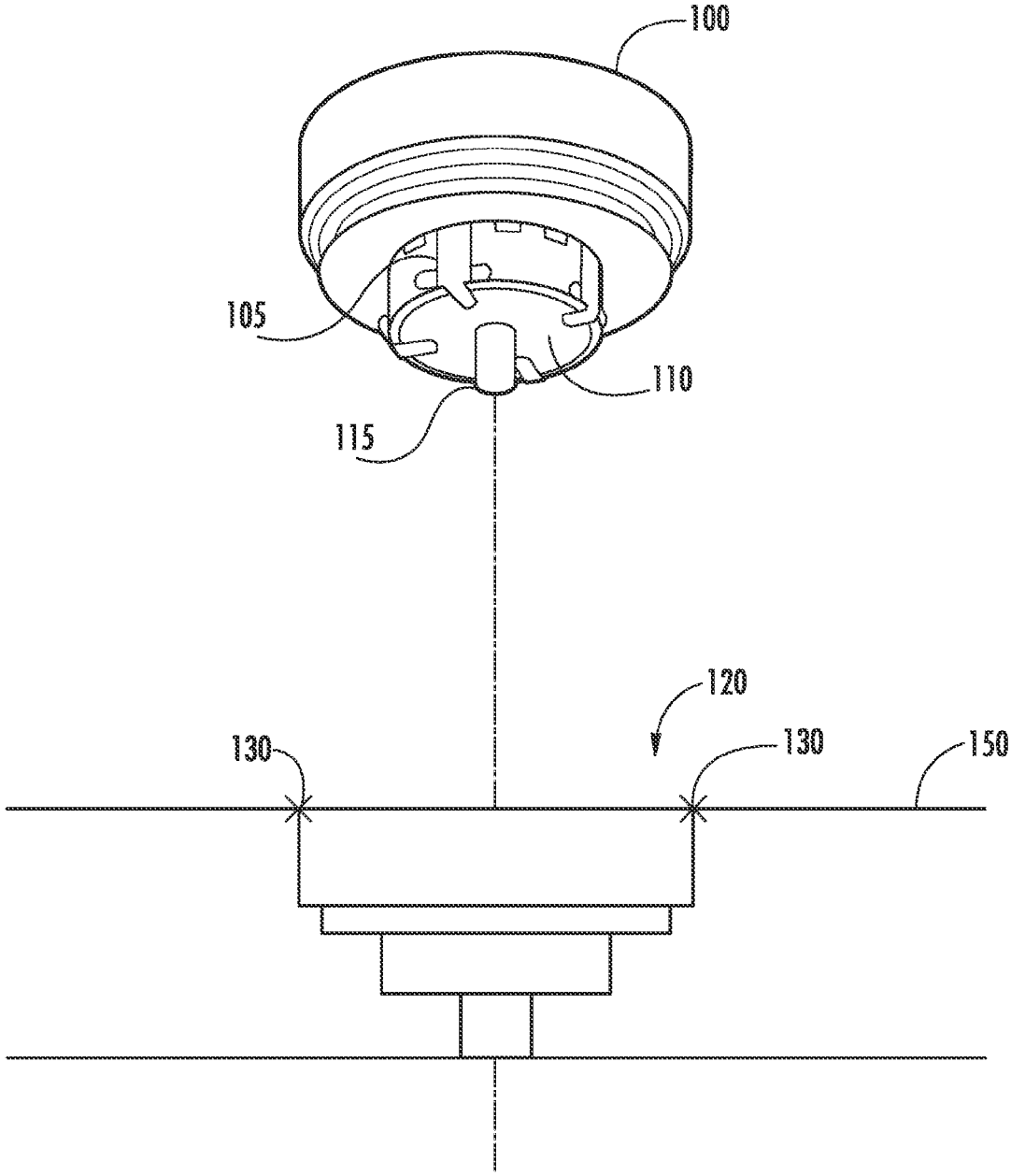
FIG. 1 (PRIOR ART)
FIG. 1 is an exploded view of a section of an electronic assembly and its hole detail as found in the prior art.
Figure 2:
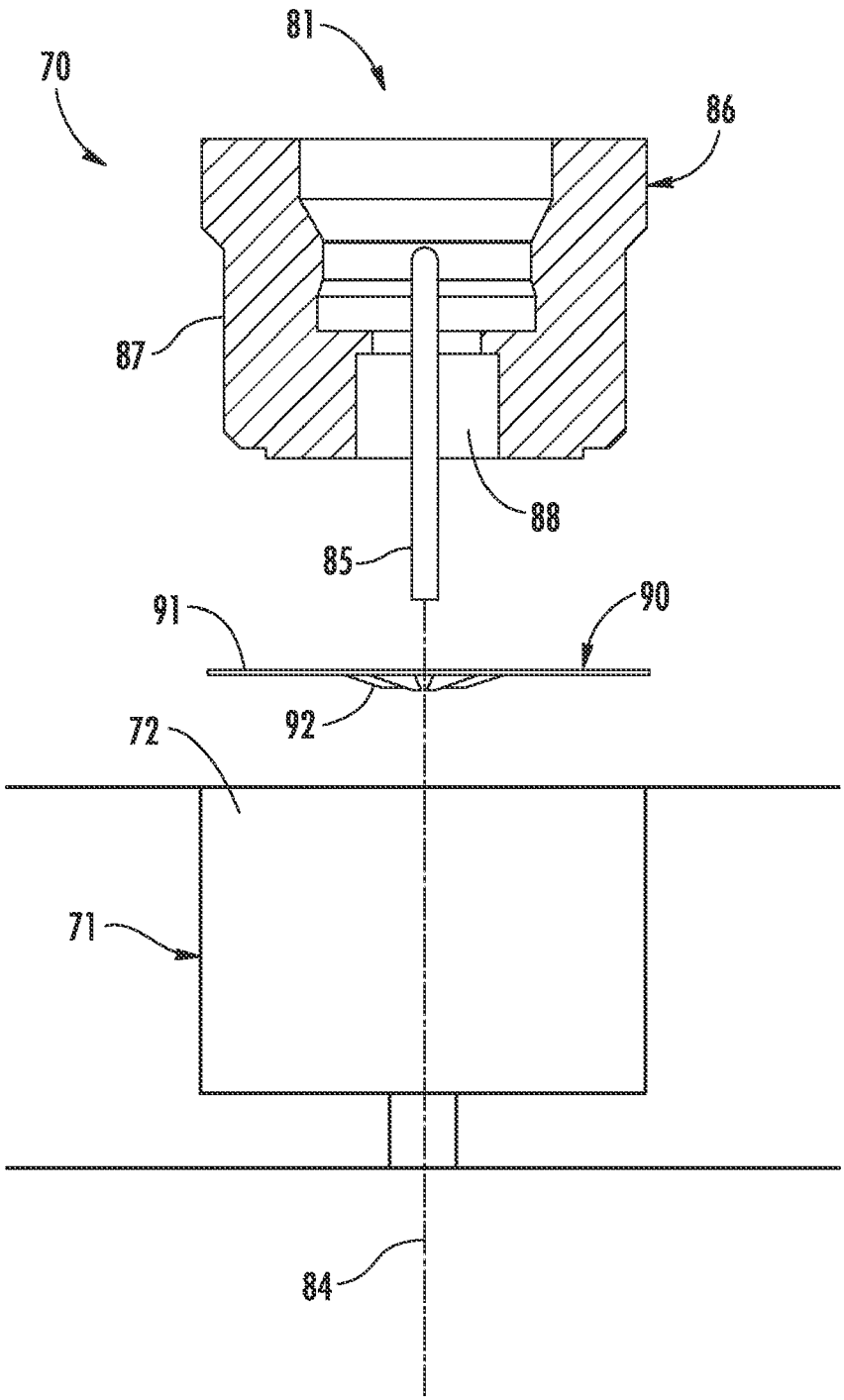
FIG. 2 is an exploded side sectional view of a electronic assembly in accordance with the invention.

Referring initially to FIG. 2, an electronic assembly 70 includes a housing 71 having an opening 72 therein that is illustratively cylindrical and has a flat bottom. The opening 72 can be other shapes. An RF feedthrough connector 81 is in the cylindrical opening 72 of the housing 71 and illustratively includes a tubular body 87. The tubular body 87 includes an explosion welded metal, for example, and other metals may be used.

Figure 6:
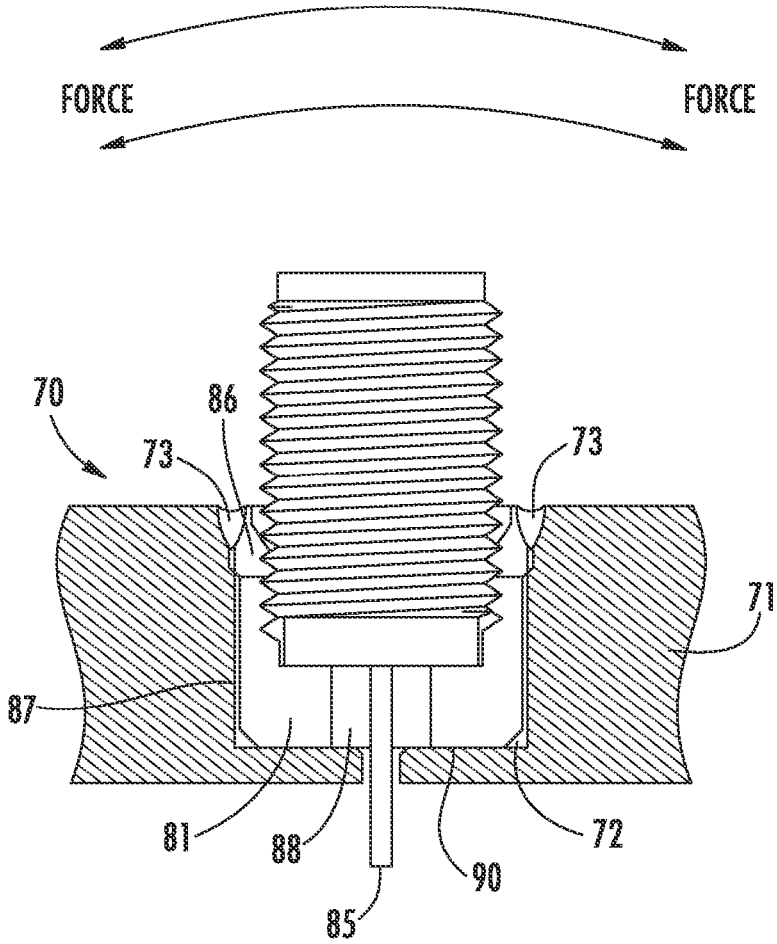
FIG. 6 is a partial sectional view of a connector including the electronic assembly of FIG. 2.

Referring additionally to FIG. 6, a sealed joint 73 is between the housing 71 and the RF feedthrough connector 81. The sealed joint includes a welded joint 73. Of course, the sealed joint may be soldered, or other metal joining techniques may be used in other embodiments.

The RF feedthrough connector 81 also includes a dielectric material 88 within the tubular body 87. A pin 85 extends through the dielectric material 88. The pin 85 may engage a center contact of a coaxial cable, for example, as will be appreciated by those skilled in the art.

Figure 4:
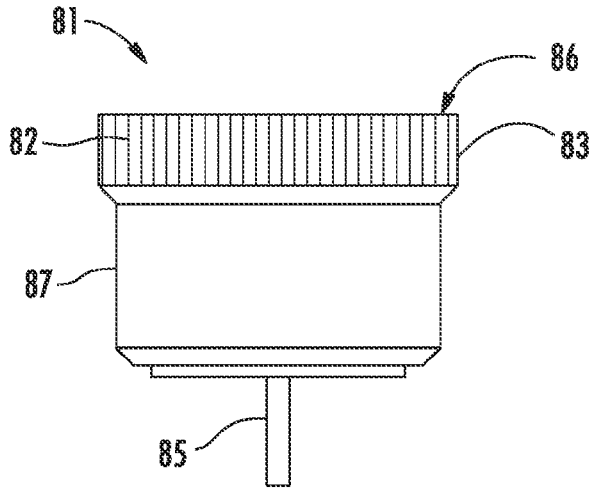
FIG. 4 is a side plan view of an RF feedthrough connector of the electronic assembly of FIG. 2.

Referring now additionally to FIG. 4, the RF feedthrough connector 81 also illustratively includes displaceable protrusions 82, or knurls, carried by an upper outer surface portion 83 of the tubular body 87. The tubular body 87 defines a longitudinal axis 84. The displaceable protrusions 82 define an enlarged upper portion 86 thereof engaging adjacent upper portions of the housing 71, and illustratively include spaced ridges extending parallel with the longitudinal axis 84. Indeed, in other embodiments the displaceable protrusions 82 may extend in other directions and need not be symmetrically arranged.

The enlarged upper portion 86 of the tubular body 87 is sized larger than the cylindrical opening 72. In some embodiments, the size of the enlarged upper portion 86 including the displaceable protrusions 82 may have an outside diameter as much as 0.005 inches greater than the cylindrical opening 72, for example, and the displaceable protrusions 82 may each extend about 0.007 inches from the tubular body 87. In other words, the outside diameter of tubular body 87 without the protrusions 82 is about 0.002 inches smaller than the diameter of the cylindrical opening 72.

The displaceable protrusions 82 are typically a softer metal than the housing 71. This allows the displaceable protrusions 82 to be displaced upon insertion of the tubular body 87 into the cylindrical opening 72. The displacement of the housing 71 as a result of the displaceable protrusions 82 is negligible.

The displaced protrusions 82 advantageously secure the tubular body 87 in the cylindrical opening 72 and center the tubular body therein. This advantageously allows the RF feedthrough connector 81 to be held in place in the housing 71 without tools during a welding operation. Additionally, the displaced protrusions 82 reduce the amount of tilting during the welding operation to maintain the RF feedthrough connector 81 bottom flat or flush against the cylindrical flat bottom opening 72.

Moreover, bending forces that may be applied to the RF feedthrough connector 81 from a coaxial cable connected thereto, for example, are reduced as the flat seating allows for a reduced force on the welded joint 73. Movement of the RF feedthrough connector in the housing 71 is also reduced. As will be appreciated by those skilled in the art, the flat seating of the RF feedthrough connector 81 in the housing 71 helps to ensure that a ground (i.e. the tubular body 87 and the housing 71) and the pin 85, which carries a signal, are in phase, and thus noise is reduced.

The displaceable protrusions 82 are especially advantageous for removal of or reworkability of the RF feedthrough connector 81. As noted above, the enlarged upper portion 86 of the tubular body 87 is sized larger than the cylindrical opening 72. This advantageously allows the RF feedthrough connector 81, and more particularly the displaceable protrusions 82 and the welded joint 73, to be cut using a conventional milling technique, for example. Other milling techniques may be used. Indeed, after the weld joint and the displaceable protrusions 82 are cut, the size of the RF feedthrough connector 81 is approximately 0.002 smaller than the cylindrical opening 72. This allows the RF feedthrough connector 81 to be removed from the housing 71 with a reduced amount of damage thereto as compared to prior art removal techniques that damage the housing 71 usually from melting and removing the weld in the welded joint 73, for example.

This advantageously allow a new RF feedthrough connector to be positioned and seated flat within the housing 71. For example, when a welded RF feedthrough connector fails and needs to be replaced, the defective RF feedthrough connector may be cut out, as described above. The defective connector is sacrificed during the cutting operation. The housing 71 is typically positioned in a milling machine to perform the cutting operation, which is typically performed visually or by probing. Correct positioning and cutting of the defective RF feedthrough connector advantageously allows the size and shape of the cylindrical opening 72 to generally be maintained to near an original size to allow a new RF feedthrough connector to be positioned in the housing 71.

A prior art RF feedthrough connector does not self-center when installed into a housing. Thus, performing a cutting operation without damaging the housing is more difficult. For example, to compensate for the off-center positioning of the RF feedthrough connector, the cutting operation results in cutting the housing to a larger diameter to remove the RF feedthrough connector.

Additionally, a prior art RF feedthrough connector generally has a straight or flat upper outer surface portion of the tubular body. Thus, the outer diameter of the upper outer surface portion of the tubular body extends to the housing. The RF feedthrough connector typically gets stuck because the gap between the upper outer surface portion of the tubular body and the housing is too tight. The inability to properly align the RF feedthrough connector adds to this problem. Accordingly, a prior art RF feedthrough connector typically requires more intensive labor to pry the connector from the housing and remove remnants. This often damages the housing beyond repair and thus, increases overall costs.

In contrast, when the displaceable protrusions 82 carried by the upper outer surface portion 83 of the tubular body 87 of an RF feedthrough connector, in accordance with the present embodiments, are cut away or removed, the RF feedthrough 81 connector is typically free to fall out of the housing 71. This advantageously reduces damage to the housing 71 and reduces overall costs.

Figure 3:
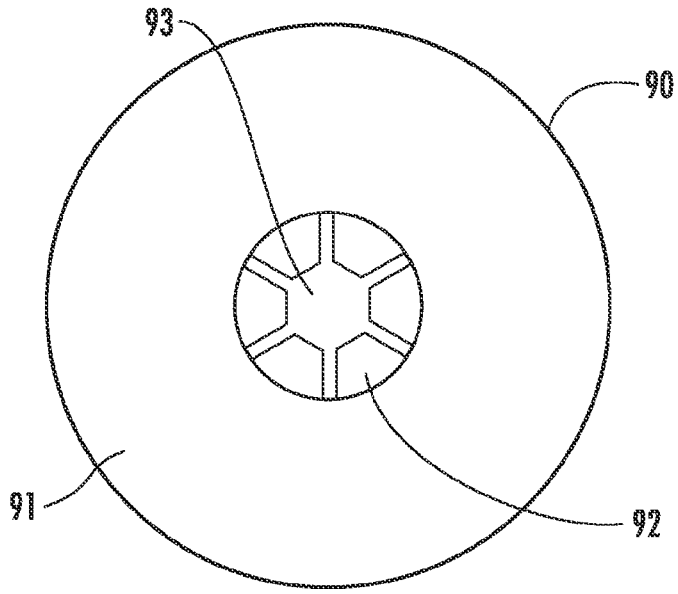
FIG. 3 is a top plan view of a flat spring of the electronic assembly of FIG. 2.

In some embodiments, a flat spring 90 is between the tubular body 87 and the housing 71 at the flat bottom of the cylindrical opening 72, as illustrated more particularly in FIG. 3. The flat spring 90 illustratively includes an annular flat portion 91 and spring petals 92 carried within an interior thereof. The spring petals 92 engage the electrically conductive metal areas adjacent to the dielectric portion 88 of the RF feedthrough connector 81. The spring petals 92 advantageously compensate for gaps that may form between the bottom portion of the tubular body 87 and the housing 71 from a temperature change, as will be appreciated by those skilled in the art. The annular flat portion 91 maintains a flat coupling of the tubular body 87 and the housing 71.

The spring petals 92 illustratively define a pin receiving passageway 93 therein. The pin receiving passageway 93 is large enough so that a center pin 85, for example, can pass through the passageway 93 without making contact therewith. As will be appreciated by those skilled in the art, the flat spring 90 helps maintain a correct location of grounding to maintain a near constant impedance. Indeed, movement of the RF feedthrough connector 81 in the housing 71 that may result in gaps between the tubular body 87 and the flat bottom of the cylindrical opening 72 would change the impedance and the ground path, and thus likely introduce unwanted noise.

Figure 5:
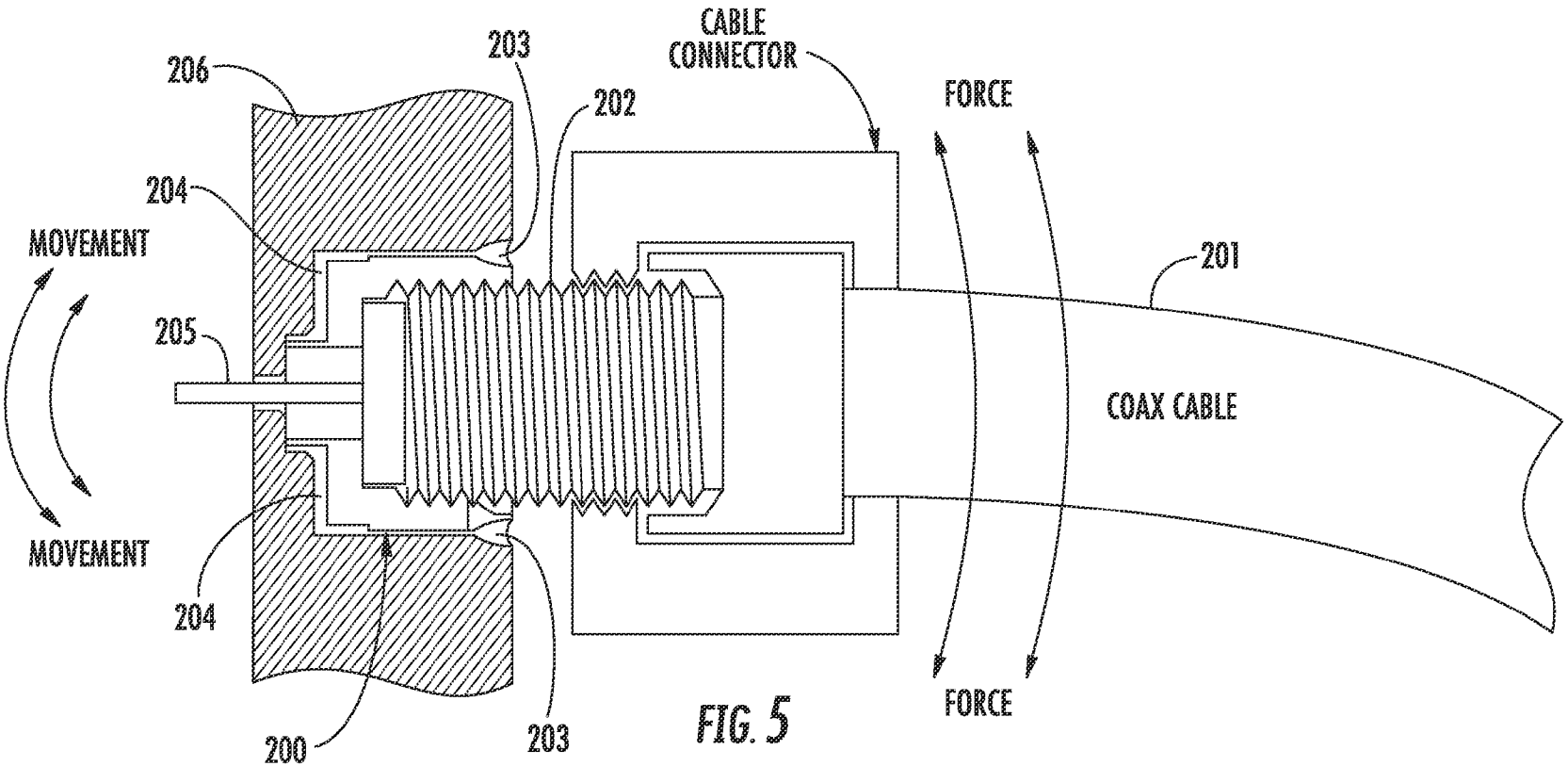
FIG. 5 PRIOR ART
FIG. 5 is a partial sectional view of an electronic assembly connected to a threaded barrel of a connector installed in accordance with the prior art.

Referring now to FIG. 5 a coaxial cable 201 is connected to a threaded barrel 202 of a coaxial cable connector 200 installed in accordance with the prior art. When a cable is connected to the threaded barrel 202 of a coaxial cable connector 200 installed in accordance with the prior art, it can create a bending moment load due to high leverage. The load creates a force that is translated through the laser weld 203, which operates somewhat as a fulcrum, and creates movement of the base of the coaxial cable connector 200 in the clearance area 204 of the ground spring. Any movement in this area 204 may cause the impedance to change and may cause variation of the RF signal. It is important that the center pin 205 of the coaxial cable connector 200 remain centered to maintain constant impedance. Movement of the base of the coaxial cable connector 200, as a force applied by a cable, can result in an impedance change that is highly undesirable.

Referring now to FIG. 6 the electronic assembly 70 addresses the problem caused by a bending movement, especially when a cable (not shown) is attached. The RF feedthrough connector 81 for the electronic assembly 70 is seated flush with the bottom of the housing 71 providing little opportunity to shift as the force shown by the right-hand arrows is applied to the tubular body 87 of the RF feedthrough connector 81. The flat spring 90, shown in FIG. 3, sits flat on the bottom of the cylindrical opening 72 and facilitates grounding between the bottom thereof and the bottom of the housing 71. Thus, even when force is applied, the RF feedthrough connector 81 has virtually no opportunity to bend and thus shift the center conductor closer to the wall of the housing 71, through which the center pin 85 passes. By being seated firmly against the bottom of the housing 71, the flat spring 90 provides intimate contact between the housing bottom and the feedthrough connector 81. This may be advantageous for a short "in-phase" ground path. The stability of the mounting reduces the force from causing shifts in impedance that would adversely affect the signal being transmitted through the feedthrough connector 81.

Thus, the prior art connector has a "loose" fit between the housing 206 and the RF feedthrough connector 207. The present connector 81, on the other hand, compresses the flat spring 90 against the bottom of the housing 71. The large contact area provides stability to the electronic assembly 70.

Another aspect is directed to a method of making an electronic assembly 70. The method includes positioning the RF feedthrough connector 81 in an opening 72 of the housing 71. The RF feedthrough connector 81 includes the tubular body 87, having displaceable protrusions 82 carried by an upper outer surface portion thereof to define an enlarged upper portion 86 thereof, to engage adjacent upper portions of the housing 71. The displaceable protrusions 82 are displaced when engaged with the adjacent upper portions of the housing 71. The method also includes forming a sealed joint between the housing 71 and the RF feedthrough connector 81.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. An electronic assembly comprising:

a housing having an opening therein;

an RF feedthrough connector in the opening of said housing and comprising a tubular body, and a plurality of displaceable protrusions carried by an upper outer surface portion of said tubular body defining an enlarged upper portion thereof engaging adjacent upper portions of said housing, and a sealed joint between said housing and said RF feedthrough connector.

2. The electronic assembly according to claim 1 wherein said tubular body defines a longitudinal axis; and wherein said plurality of displaceable protrusions comprise a plurality of spaced ridges extending parallel with the longitudinal axis.

3. The electronic assembly according to claim 1 wherein said sealed joint comprises a welded joint.

4. The electronic assembly according to claim 1 wherein the opening comprises a cylindrical opening having a flat bottom.

5. The electronic assembly according to claim 4 further comprising a flat spring between said tubular body and said housing at the flat bottom of the cylindrical opening.

6. The electronic assembly according to claim 5 wherein said flat spring comprises an annular flat portion and a plurality of spring petals carried within an interior thereof.

7. The electronic assembly according to claim 6 wherein said plurality of spring petals define a pin receiving passageway therein.

8. The electronic assembly according to claim 1 wherein said RF feedthrough connector further comprises:

a dielectric material within said tubular body; and at least one pin extending through said dielectric material.

9. The electronic assembly according to claim 1 wherein said tubular body comprises explosion welded metal.

10. An electronic assembly comprising:

a housing having a cylindrical opening having a flat bottom therein;

an RF feedthrough connector in the cylindrical opening of said housing and comprising a tubular body;

a flat spring between said tubular body and said housing at the flat bottom of the cylindrical opening, said flat spring comprising an annular flat portion and a plurality of spring petals carried within an interior thereof; and a sealed joint between said housing and said RF feedthrough connector.

11. The electronic assembly according to claim 10 wherein said plurality of spring petals define a pin receiving passageway therein.

12. The electronic assembly according to claim 10 wherein said sealed joint comprises a welded joint.

13. The electronic assembly according to claim 10 wherein said RF feedthrough connector further comprises:

a dielectric material within said tubular body; and at least one pin extending through said dielectric material.

14. The electronic assembly according to claim 10 wherein said tubular body comprises explosion welded metal.

15. A method of making an electronic assembly comprising:

positioning an RF feedthrough connector in an opening of a housing comprising a tubular body having a plurality of displaceable protrusions carried by an upper outer surface portion thereof to define an enlarged upper portion thereof to engage adjacent upper portions of the housing, the plurality of displaceable protrusions being displaced when engaged with the adjacent upper portions of the housing; and forming a sealed joint between the housing and the RF feedthrough connector.

16. The method according to claim 15 wherein the tubular body defines a longitudinal axis; and wherein the plurality of displaceable protrusions comprise a plurality of spaced ridges extending parallel with the longitudinal axis.

17. The method according to claim 15 wherein forming the sealed joint comprises a forming welded joint.

18. The method according to claim 15 wherein the opening comprises a cylindrical opening having a flat bottom.

19. The method according to claim 18 further comprising positioning a flat spring between the tubular body and the housing at the flat bottom of the cylindrical opening.

20. The method according to claim 19 wherein the flat spring comprises an annular flat portion and a plurality of spring petals carried within an interior thereof.

21. The method according to claim 20 wherein the plurality of spring petals define a pin receiving passageway therein.

22. The method according to claim 15 wherein the tubular body comprises explosion welded metal.

23. A method of making an electronic assembly comprising:

positioning an RF feedthrough connector in a cylindrical opening of a housing and comprising a tubular body, and a flat spring between the tubular body and the housing at the flat bottom of the cylindrical opening, the flat spring comprising an annular flat portion and a plurality of spring petals carried within an interior thereof; and forming a sealed joint between the housing and the RF feedthrough connector.

24. The method according to claim 23 wherein the plurality of spring petals define a pin receiving passageway therein.

25. The method according to claim 23 wherein the sealed joint comprises a welded joint.

* * * * *